US007771163B2

(12) United States Patent
Betti et al.

(10) Patent No.: US 7,771,163 B2
(45) Date of Patent: Aug. 10, 2010

(54) DISK WHEEL OF A ROTOR OF A TURBOMACHINE

(75) Inventors: Davide Betti, Viareggio (IT); Andrea Cianti, San Casciano Val di Pesa (IT); Lorenza Sassolini, Umbertide (IT)

(73) Assignee: Nuovo Pignone S.p.A., Florence (IT)

( * ) Notice: Subject to any disclaimer, the term of this patent is extended or adjusted under 35 U.S.C. 154(b) by 777 days.

(21) Appl. No.: 11/613,826

(22) Filed: Dec. 20, 2006

(65) Prior Publication Data

US 2008/0008594 A1 Jan. 10, 2008

(30) Foreign Application Priority Data

Dec. 28, 2005 (IT) ..... MI05A2504

(51) Int. Cl.
*F04D 29/58* (2006.01)

(52) U.S. Cl. ..... 415/209.1; 416/244 R

(58) Field of Classification Search ..... 415/209.1, 415/209.2, 209.3, 204 R, 198 R, 244 R; 416/198 R, 416/244 R See application file for complete search history.

(56) References Cited

U.S. PATENT DOCUMENTS

| | | | | |
|---|---|---|---|---|
| 4,123,199 | A * | 10/1978 | Shimizu et al. | 416/244 A |
| 4,477,227 | A | 10/1984 | Klufas | |
| 5,205,716 | A | 4/1993 | Georges et al. | |
| 6,364,634 | B1 | 4/2002 | Svihla et al. | |

* cited by examiner

*Primary Examiner*—Edward Look
*Assistant Examiner*—Dwayne J White
(74) *Attorney, Agent, or Firm*—Potomac Patent Group PLLC

(57) ABSTRACT

Disk wheel (10) of a rotor of a turbomachine of the type equipped with a series of blades (12) integral with a central annular portion (14) which is fitted on a shaft (20) of the turbomachine, the disk wheel comprises at least a first insertable portion (18) of the female or male type situated close to a base end of the central annular portion (14), which is suitable for being coupled with at least a corresponding second insertable portion (38) of the male or female type integral with the shaft (20) so as to increase the reliability of the disk wheel (10) itself.

20 Claims, 3 Drawing Sheets

DISK WHEEL OF A ROTOR OF A TURBOMACHINE

BACKGROUND

The present invention relates to a disk wheel of a rotor of a turbomachine such as in particular a turbine or compressor.

In particular, the present invention relates to a disk wheel of the type comprising a series of blades made integral with a central ring.

The disk wheel is fitted together with others of the same type on a shaft of a turbomachine in order to obtain a rotor.

Each disk wheel is then heated and inserted on the shaft so that, after cooling, it remains forced on the shaft itself by interference.

When operating on the blades of each disk wheel, stress is created, which is transmitted by friction to the shaft through the central portion.

In order to increase safety and also the possibility of transmitting high rotation rates to the shaft, grooves for corresponding flaps or keys are normally produced in the internal surface of the central annular portion, in order to fix the disk wheel in position more firmly with respect to the shaft.

This however leads to the disadvantage that under particular operating conditions such as in the presence of corrosive gases for example, an intensification of the stress is created in correspondence with the seats for the flaps, which is further increased by corrosion phenomena.

In other words, corrosion under stress is caused, which is intensified in correspondence with each seat of each key.

With time, this causes breakages, frequently unexpected, as the fractures propagate very rapidly as a result of the corrosive agents.

This consequently jeopardizes the reliability of the rotor and whole turbomachine.

BRIEF SUMMARY OF THE INVENTION

An objective of the present invention is to provide a disk wheel of a rotor of a turbomachine which allows a reduction in the stress intensification factors on the disk wheel.

A further objective is to provide a disk wheel of a rotor of a turbomachine which avoids the use of flaps interposed between the shaft and disk wheel and which avoids the production of housings for the same.

A further objective is to provide a disk wheel of a rotor of a turbomachine which increases the reliability and useful life of the disk wheel and consequently also of the turbomachine.

Yet another objective is to provide a disk wheel of a rotor of a turbomachine which is economically advantageous.

These objectives according to the present invention are achieved by providing a disk wheel of a rotor of a turbomachine as specified in claim 1.

Further characteristics of the invention are indicated by the subsequent claims.

BRIEF DESCRIPTION OF THE DRAWINGS

The characteristics and advantages of a disk wheel of a rotor of a turbomachine according to the invention will appear more evident from the following illustrative and non-limiting description, referring to the enclosed schematic drawings, in which.

DETAILED DESCRIPTION OF THE INVENTION

Figure 1:
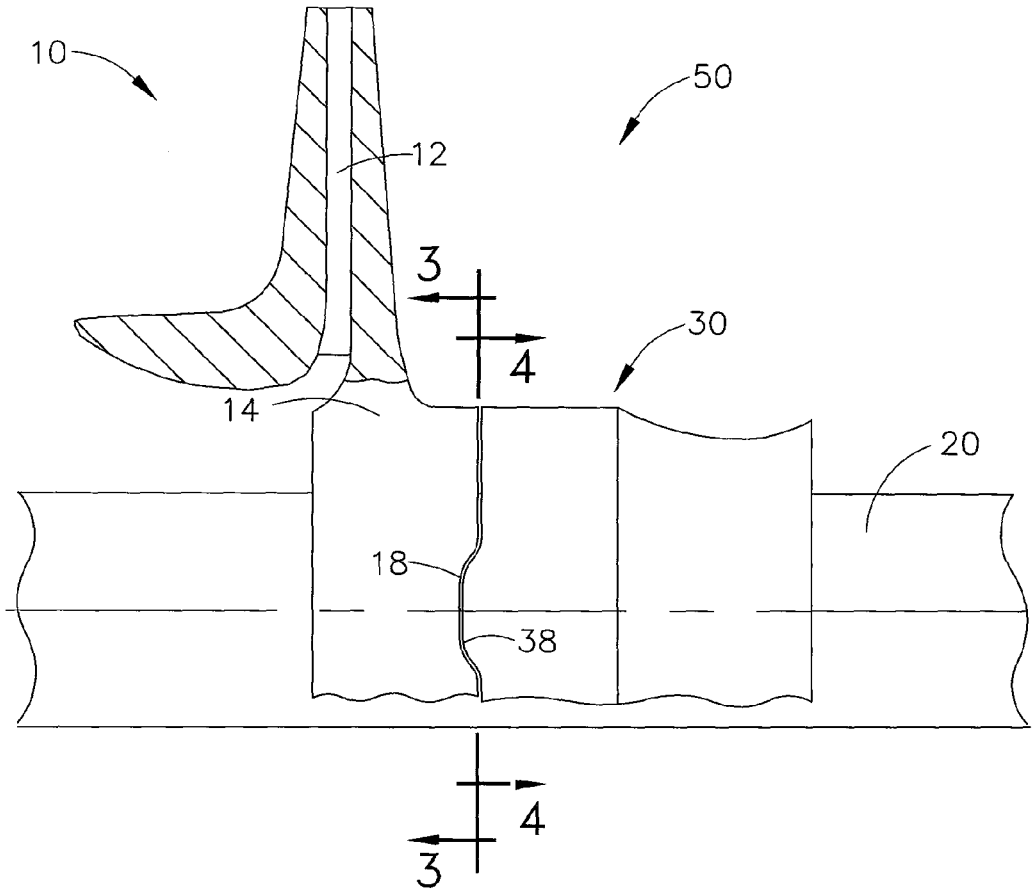
FIG. 1 is a raised partially sectional side view of a preferred embodiment of a disk wheel of a rotor of a turbomachine according to the present invention.
Figure 2:
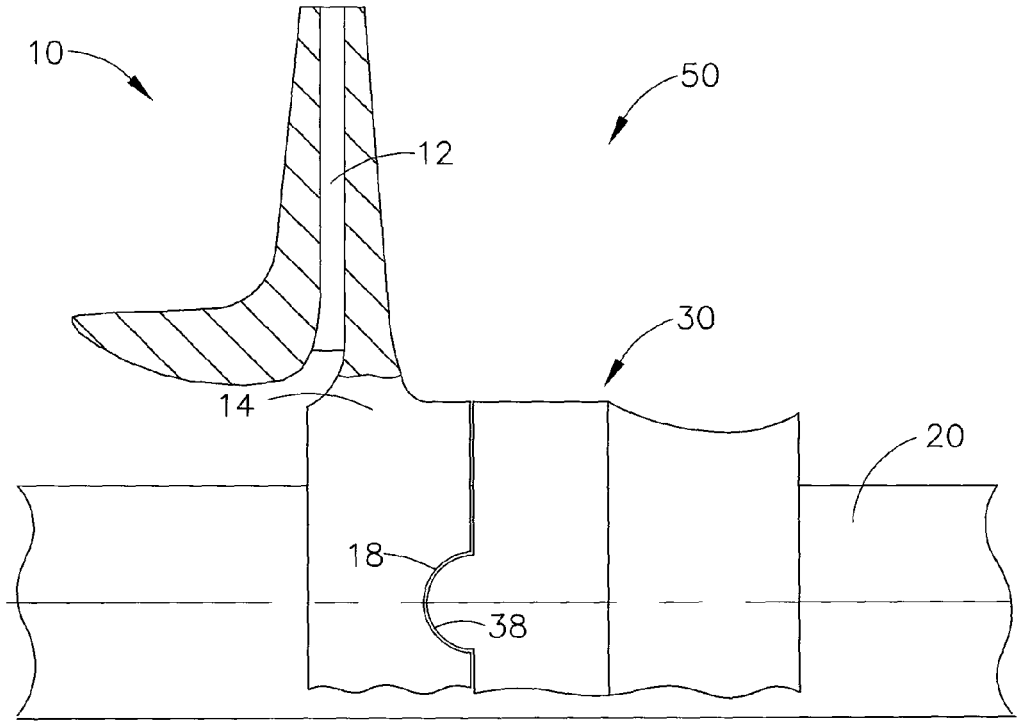
FIG. 2 is a raised partially sectional side view of another preferred embodiment of a disk wheel of a rotor of a turbomachine according to the present invention.

With reference to the figures, FIGS. 1 and 2 show a disk wheel 10 of a rotor of a turbomachine of the type equipped with a series of blades 12 made integral with a central annular portion 14 which is interference fitted on a shaft 20 of said turbomachine, characterized in that it comprises at least a first insertable portion 18 of the female or male type situated close to a base end of said central annular portion 14, which is suitable for being coupled with at least a corresponding second insertable portion 38 of the male or female type made integral with the shaft 20 so as to increase the reliability of the disk wheel 10 itself.

According to a first preferred embodiment, said at least one first insertable portion 18 is at least an axial insertable portion of the shaped female type, and preferably said at least one corresponding second insertable portion 38 is at least an axial insertable portion of the male type correspondingly shaped so as to avoid stress intensification on the disk wheel.

According to a second preferred embodiment, said at least one first insertable portion 18 is at least an axial insertable portion of the shaped male type, and preferably said at least one corresponding second insertable portion 38 is at least an axial insertable portion of the female type correspondingly shaped so as to avoid stress intensification on the disk wheel.

Said at least one axial insertable portion of the female type is preferably at least a substantially semi-elliptic or semicircular shaped axial seat, to allow a better stress distribution on the disk wheel itself.

Said at least one axial insertable portion of the female type is preferably a substantially semi-elliptic shaped axial seat.

Said at least one axial insertable portion of the female type is preferably a substantially semicircular shaped axial seat.

Said at least one axial insertable portion of the shaped male type is preferably at least a substantially semi-elliptic or semicircular shaped axial protuberance, to allow a better stress distribution on the disk wheel.

Said at least one axial insertable portion of the shaped male type is preferably a substantially semi-elliptic shaped axial protuberance.

Said at least one axial insertable portion of the shaped male type is preferably a substantially semicircular shaped protuberance.

A disk wheel of a rotor according to the present invention advantageously allows a reduction in the intensification factors of the stress to which said disk wheel is subjected when operating, consequently increasing its reliability and useful life.

According to the present invention, a rotor 50 of a turbomachine is also provided, comprising at least one disk wheel 10 of the type previously described, and also comprising at least one corresponding spacer ring 30 on which said at least one corresponding insertable second portion 38 is preferably situated.

Said at least one corresponding spacer ring 30 is also fitted by interference on said shaft 20 between one disk wheel and another.

In this way it is possible to considerably increase the friction surface as each disk wheel is engaged with at least one corresponding spacer ring 30.

Figure 3:
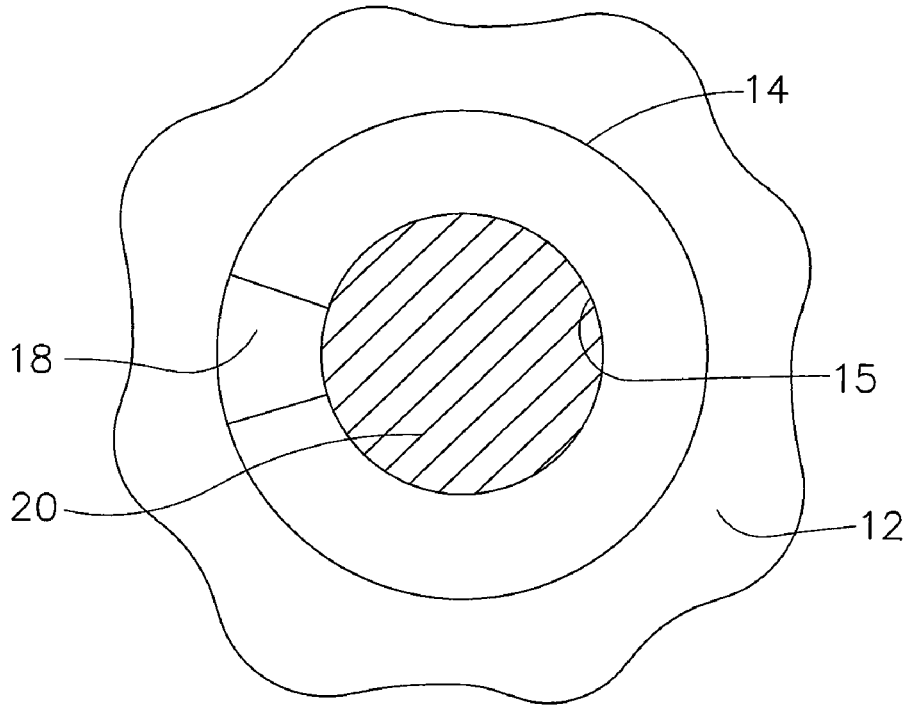
FIG. 3 is a cross-sectional view along lines 3-3 of FIG. 1.
Figure 4:
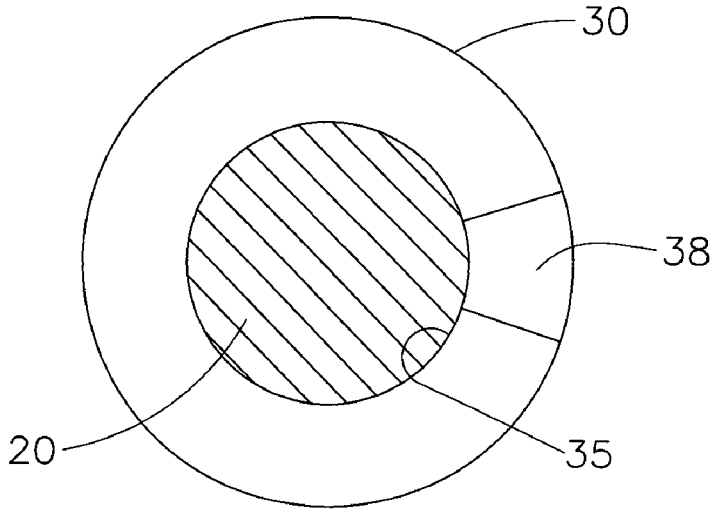
FIG. 4 is a cross-sectional view along lines 4-4 of FIG. 1.

In order to determine a relative rotation between the disk wheel and shaft it is therefore necessary to overcome both the friction forces of the disk wheel, proportional to the contact surface 15 (see FIG. 3) of the disk wheel 10 with the shaft 20, and also the friction forces of the spacer ring 30, proportional to the contact surface 35 (see FIG. 4) of the spacer ring 30 with the shaft 20.

It can thus be seen that a disk wheel of a rotor of a turbomachine according to the present invention achieves the objectives indicated above.

The disk wheel of a rotor of a turbomachine of the present invention thus conceived can undergo numerous modifications and variants, all included in the same inventive concept.

Furthermore, in practice, the materials used as also the dimensions and components can vary according to technical demands.

What is claimed is:

1. A disk wheel of a rotor for a turbomachine having a shaft, said disk wheel comprising:

a central annular portion having an interior surface sized to be interference fitted on the shaft, a series of blades integral with said central annular portion and at least a first insertable portion of the female or male type situated close to a base end of the said central annular portion, wherein said at least a first insertable portion is suitable for being coupled with at least a corresponding second insertable portion of the male or female type integral with the shaft so as to increase the reliability of the disk wheel itself.

2. The disk wheel according to claim 1, wherein:

said at least a first insertable portion is at least an insertable axial portion of the shaped female type, and said at least one corresponding second insertable portion is at least an insertable axial portion of the male type correspondingly shaped so as to avoid stress intensification on the disk wheel.

3. The disk wheel according to claim 1, wherein:

said at least a first insertable portion is at least an insertable axial portion of the shaped male type, and said at least one corresponding second insertable portion is at least an insertable axial portion of the female type correspondingly shaped so as to avoid stress intensification on the disk wheel.

4. The disk wheel according to claim 1, wherein said at least an insertable axial portion of the female type is at least a substantially semi-elliptic or semicircular shaped axial seat, to allow a better stress distribution on the disk wheel itself.

5. The disk wheel according to claim 4, wherein said at least one axial insertable portion of the female type is a substantially semi-elliptic shaped axial seat.

6. The disk wheel according to claim 4, wherein said at least one axial insertable portion of the female type is a substantially semicircular shaped axial seat.

7. The disk wheel according to claim 1, wherein said at least one axial insertable portion of the shaped male type is at least a substantially semi-elliptic or semicircular shaped axial protuberance, to allow a better stress distribution on the disk wheel.

8. The disk wheel according to claim 7, wherein said at least one axial insertable portion of the shaped male type is preferably a substantially semi-elliptic shaped axial protuberance.

9. The disk wheel according to claim 7, wherein said at least one axial insertable portion of the shaped male type is a substantially semicircular shaped axial protuberance.

10. A rotor of a turbomachine comprising:

a shaft, at least one disk wheel including a central annular portion interference fitted on said shaft, a series of blades integral with said disk wheel central annular portion, at least a first insertable portion of the female or male type situated close to a base end of said central annular portion, wherein said at least a first insertable portion is suitable for being coupled with at least a corresponding second insertable portion of the male or female type, and at least one corresponding spacer ring on which said at least one corresponding insertable second portion is situated, said at least one corresponding spacer ring also being interference fitted on said shaft, and wherein said corresponding at least first and second insertable portions are coupled so as to increase the reliability of the disk wheel itself.

11. A rotor according to claim 10, wherein there is an absence of flaps interposed between said shaft and said disk wheel.

12. A rotor according to claim 11, wherein:

said at least a first insertable portion is an insertable axial portion of the shaped female type having a substantially semi-elliptic axial seat, and said corresponding spacer ring insertable second portion is an axial insertable portion of the shaped male type having a substantially semi-elliptic shaped axial protuberance to engage said substantially semi-elliptic axial seat.

13. The rotor of claim 10, further comprising:

said disk wheel including an internal contact surface in contact with said shaft in said interference fit of said disk wheel on said shaft providing a first force proportional to said disk wheel internal contact surface with said shaft, and said spacer ring including an internal contact surface in contact with said shaft in said interference fit of said spacer ring on said shaft providing a second force proportional to said spacer ring internal contact surface with said shaft, and wherein engagement of said first insertable portion of said disk wheel with said corresponding second insertable portion of said spacer ring combines said first force and said second force to prevent relative rotation between said disk wheel and said shaft without the use of flaps interposed between said shaft and said disk wheel.

14. The rotor of claim 13, wherein said disk wheel contact surface is an internal surface of said central annular portion, said disk wheel contact surface not including grooves.

15. A spacer ring for a rotor of a turbomachine, wherein:

said turbomachine is of the type equipped with a disk wheel having a series of blades integral with a central annular portion which is interference fitted on a shaft of said turbomachine, and said disk wheel central annular portion includes an internal contact surface without grooves for contacting said shaft in said interference fit and at least a first insertable portion of the female or male type situated close to a base end of said central annular portion, said spacer ring comprises:

a second insertable portion of the male or female type corresponding to said first insertable portion and a contact surface for engaging said shaft in an interference fit.

16. The spacer ring according to claim 15, wherein:

said second insertable portion is at least an insertable axial portion of the shaped male type and said corresponding at least a first insertable portion is at least an insertable axial portion of the female type correspondingly shaped so as to avoid stress intensification on the disk wheel.

17. The spacer ring according to claim 15, wherein:

the disk wheel first insertable portion is an axial insertable portion of the female type having a substantially semi-elliptic or semicircular shaped axial seat, said spacer ring second insertable portion is an axial insertable portion of the shaped male type and is at least a substantially semi-elliptic or semicircular shaped axial protuberance corresponding to said first insertable portion to allow a better stress distribution on the disk wheel.

18. The spacer ring according to claim 17, wherein said at least one axial insertable portion of the male type is a substantially semi-elliptic shaped axial protuberance.

19. The spacer ring according to claim 17, wherein said at least one axial insertable portion of the male type is a substantially semicircular shaped axial protuberance.

20. The spacer ring according to claim 15, wherein:

said second insertable portion is at least an insertable axial portion of the shaped female type, and said corresponding at least a first insertable portion is at least an insertable axial portion of the male type correspondingly shaped so as to avoid stress intensification on the disk wheel.

* * * * *

UNITED STATES PATENT AND TRADEMARK OFFICE

CERTIFICATE OF CORRECTION

PATENT NO. : 7,771,163 B2
APPLICATION NO. : 11/613826
DATED : August 10, 2010
INVENTOR(S) : Betti et al.

It is certified that error appears in the above-identified patent and that said Letters Patent is hereby corrected as shown below:

In Column 3, Line 22, in Claim 1, delete "portion" and insert -- portion, --, therefor.

In Column 3, Line 63, in Claim 8, delete "preferably a" and insert -- a --, therefor.

Signed and Sealed this

Ninth Day of November, 2010

David J. Kappos

David J. Kappos
*Director of the United States Patent and Trademark Office*